US006097379A

United States Patent [19]

Ichiraku

[11] Patent Number: 6,097,379

[45] **Date of Patent: *Aug. 1, 2000**

[54] LIQUID CRYSTAL DISPLAY DEVICE

[75] Inventor: Tsuyoshi Ichiraku, Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/979,801

[22] Filed: Nov. 26, 1997

[30] Foreign Application Priority Data

Nov. 28, 1996 [JP] Japan ..... 8-317601

[51] Int. Cl.[7] ..... G09G 5/00

[52] U.S. Cl. ..... 345/213; 348/790

[58] Field of Search ..... 345/213, 99, 204, 345/208, 210, 211, 212; 348/790, 792

[56] References Cited

U.S. PATENT DOCUMENTS

| | | | |
|---|---|---|---|
| 4,780,759 | 10/1988 | Matsushima et al. | 358/148 |
| 5,654,735 | 8/1997 | Nakajima | 345/99 |
| 5,894,299 | 4/1999 | Tsuchiya et al. | 345/100 |
| 5,914,699 | 6/1999 | Imamura | 345/99 |
| 5,917,777 | 6/1999 | Tanigawa | 368/10 |

FOREIGN PATENT DOCUMENTS

| | | |
|---|---|---|
| 0 577 841 | 1/1994 | European Pat. Off. . |
| 0 791 913 | 8/1997 | European Pat. Off. . |
| 4-276791 | 10/1992 | Japan . |

OTHER PUBLICATIONS

"Automatic Phase Adjustment", IBM Technical Disclosure Bulletin, vol. 37, No. 5, May 1994, pp. 203–204.

*Primary Examiner*—Vijay Shankar
*Assistant Examiner*—Vanel Frenel
*Attorney, Agent, or Firm*—Sughrue, Mion, Zinn, Macpeak & Seas, PLLC

[57] ABSTRACT

A liquid crystal display device is realized which facilitates the automatic display adjustment of moving images, and which effectively detects noise or the like interfering with the video signal. The liquid crystal display device is provided with: PLO circuit one, which generates a standard clock (PCLK) which is synchronized with a horizontal synchronizing signal; a phase adjusting circuit two, which includes a divider circuit 11, a delay circuit 12, a sampling circuit for detection 13, a stable period detecting circuit 14 and a controller 15, and which automatically phase of the standard clock (PCLK), and outputs a N divided sampling clock (SCLK); a pixel data sampling circuit three, into which the video signal is inputted, and which outputs sampling data obtained in accordance with the sampling clock (SCLK); a liquid crystal drive circuit 4, which outputs a liquid crystal drive signal; a video signal processing signal 6, which conducts video processing including gamma correction, polarity inversion, and the like with respect to the sampling data; and a liquid crystal panel five into which the video processed image data are inputted, and which displays these data.

12 Claims, 7 Drawing Sheets

LIQUID CRYSTAL DISPLAY DEVICE

BACKGROUND OF THE INVENTION

1. Field of the Invention

The present invention relates to a liquid crystal display device, and in particular, relates to a liquid crystal display device into which video signals outputted from a personal computer or the like are inputted, and which displays the signals.

2. Description of Related Art

Conventionally, in this type of liquid crystal display device, the video signals which are to be displayed and which are outputted by a personal computer or the like differ from video signals in televisions or the like, in that these video signals are not completely continuously outputted, but are signals in which a fixed potential is maintained for each pixel; furthermore, in the corresponding liquid crystal display device itself, it is not the case that the video signal of one scanning line is continuously displayed, but rather a function is provided in which a video signal sampled pixel by pixel is displayed. This sampling function is provided in the liquid crystal display device; the video signal inputted from a personal computer or the like is displayed after being subjected to sampling within the liquid crystal display device. In the case in which the point at which the video signal is sampled within the liquid crystal display device is not the timing at which a fixed potential of the pixels is maintained, but rather the timing at which the pixels are switched, the following problems occur.

That is to say, there is a problem in that, because sampling of the inputted video signal is conducted at the point at which the potential changes, a constant sampling potential is not obtainable in the set up period or the hold period required in the sampling circuit, and the sampling potential becomes unstable. Furthermore, a situation is created in which, as a result of the influence of jitter in the sampling clock, pre-change pixel data may be sampled in a certain frame, while in the subsequent frame, post-change pixel data may be sampled. As a result of these phenomena, the edges of images in the liquid crystal display seem to flicker and the display quality of the images declines markedly. Accordingly, in such liquid crystal display devices, in order to ameliorate the decline in image quality by means of optimizing the sampling point, a circuit which regulates the phase of the sampling clock becomes necessary.

FIG. 5 is a block diagram showing the structure of the essential parts of a conventional liquid crystal display device in which the adjustment of the sampling clock phase referred to above is performed by the user of the liquid crystal display device while observing the display screen. As shown in FIG. 5, this conventional example is provided with: PLL circuit 1, which creates and outputs a clock PCLK which is phase synchronized with a horizontal synchronizing signal; a phase adjusting circuit 2, which includes a phase adjusting switch 51 and a delay circuit 52, and which adjusts the phase of clock PCLK and outputs a clock SCLK; a sampling pixel data sampling circuit 3, into which a video signal is inputted, and which outputs sampling data via sampling clock SCLK; a liquid crystal drive circuit 4, into which a vertical synchronizing signal and the horizontal synchronizing signal are inputted, and which generates and outputs a liquid crystal display control signal; a liquid crystal panel 5, which displays the video signals which have been video processed; and a video signal processing circuit 6, which processes the sampling data. Normally, a dot clock is not outputted from a personal computer or the like; only a synchronizing signal is outputted. Accordingly, in this type of liquid crystal display device, in order to conduct the sampling of the video signal, a PLL circuit 1 which generates a clock PCLK which is synchronized with the horizontal synchronizing signal is necessary, and this is provided as one of the essential structural elements above.

In FIG. 5, PLL circuit 1 receives the input of the horizontal synchronizing signal, and a clock PCLK which is phase synchronized with the horizontal synchronizing signal is generated and inputted into delay circuit 52. In delay circuit 52, as a result of the manipulation of an operator conducted while viewing the display screen, the delay adjusted signal outputted from phase adjusting switch 51 is received, the phase delay amount of the clock PCLK is controlled and adjusted, and the phase adjusted sampling clock SCLK is outputted and this is inputted into pixel data sampling circuit 3. In pixel data sampling circuit 3, sampling clock SCLK is inputted, and via this sampling clock SCLK, the video signals R/G/B inputted from the personal computer are subjected to sampling. The sampling data output of pixel data sampling circuit 3 is inputted into video processing circuit 6, processing including gamma correction, polarity reversal, and the like is conducted, liquid crystal drive data are generated, these are inputted into liquid crystal panel 5, and display is conducted via the liquid crystal display control signal outputted from liquid crystal drive circuit 4. The liquid crystal display control signal receives the input of the vertical synchronizing signal and the horizontal synchronizing signal and is generated in liquid crystal drive circuit 4, and is inputted into liquid crystal panel 6.

Next, FIG. 6 shows a block diagram of the structure of a different conventional phase adjusting circuit, disclosed in Japanese Patent Application, First Publication, No. Hei 7-219485. As shown in FIG. 6, this phase adjusting circuit comprises: an adjustment initiation switch 66; a controller 63 which accepts as inputs a horizontal synchronizing signal, an operation initiation signal outputted from adjustment initiation switch 66, and a clock PCLK, and outputs a delay adjusting signal; a delay circuit 61, which accepts as inputs the delay adjusting signal and the clock PCLK, and generates and outputs a sampling clock SCLK; an A/D converter 62, which accepts as inputs the sampling clock SCLK, a video signal, and the delay adjusting signal, and subjects the video signal to A/D conversion and outputs this; a memory 65, which accepts as inputs the A/D converted output of the A/D converter 62 and the delay adjusting signal, and which stores the A/D converted output; and a comparator circuit 64, which compares the A/D converted output of the A/D converter 62 and the output of memory 65, and transmits the results of this comparison to controller 63.

In FIG. 6, the video signal inputted from a personal computer or the like is synchronized with sampling clock SCLK and subjected to sampling in A/D converter 62, and is also converted to a digital signal. The prespecified pixel data of a certain frame subjected to sampling in A/D converter 62 are temporarily stored in memory 65. The pixel data stored in memory 65 are compared in comparator circuit 64 with the pixel data corresponding to the same pixel in the subsequent frame, and any difference between these data is detected. In the case in which there was a difference in the results of the comparison, the phase of the sampling clock SCLK is determined to be inappropriate, and via the control function of controller 63, the delay amount in delay circuit 61 is controlled and adjusted, and a comparison of the sampling data is again conducted over a number of frames, and this is repeated until the results of the comparison are in agreement and no difference is generated. In the case of such agreement, the phase of the sampling clock SCLK is determined to be appropriate, and via the control function of controller 63, the delay amount of delay circuit 61 is fixed. The phase adjustment in this conventional example is only initiated when the adjustment initiation switch 66 is placed in the ON position by the operator; the controller 63 receives as an input the operation initiation signal outputted from adjustment initiation switch 66, and the control function of controller 63 commences, and after this, all operations are conducted automatically.

FIG. 7 is a block diagram showing the structure of another conventional phase adjusting circuit, which was disclosed in Japanese Patent Application, First Publication, No. Hei 5-199483. As shown in FIG. 7, this phase adjusting circuit is provided with an edge detecting circuit 71, which detects and outputs the beginning edge of the video signal, and a synchronizing signal 72, which accepts as inputs a clock PCLK and the edge detection output of the edge detecting circuit 71, and which generates and outputs a sampling clock SCLK.

In FIG. 7, in edge detecting circuit 71, the edge of the video signal inputted from a personal computer or the like is detected, and a set pulse is outputted at a timing delayed by a prespecified period from the timing of this edge, and this set pulse is inputted into synchronizing circuit 72. In synchronizing circuit 72, the set pulse is accepted as input, the frequency of the clock PCLK synchronized with the set pulse is N-divided, and a sampling clock SCLK is generated and outputted. By means of this, a sampling clock is obtained which is synchronized with the edge of the inputted video signal. In this case, as the division value N becomes larger in synchronizing circuit 72, it is possible to restrict the phase error to a smaller value, and N is commonly set to a value of 8 or more. Furthermore, by means of delaying the timing of the set pulse by a prespecified amount from the edge, the phase difference between the video signal and the sampling clock SCLK is fixed and optimized, and thereby the adjustment of the sampling point may be realized automatically.

In the conventional liquid crystal display devices described above, in the case of the conventional example shown in FIG. 5, the operator manipulates a switch while viewing the display screen, and thereby, the timing adjustment of the sampling clock SCLK is conducted, but there is a disadvantage in that the manipulations of the operator may become complex.

Furthermore, in the conventional phase adjusting circuit shown in FIG. 6, by means of conducting a comparison of the sampling data of the video data corresponding to a certain pixel frame by frame, the timing adjustment of the sampling point with respect to the video signal is conducted; however, in the case of moving images in which the display screen changes frame by frame, the inputted video signal changes with each frame, and a comparison between frame units will never result in agreement, and it is thus impossible to conduct optimal timing adjustment, and this represents a drawback in that the displayed images during adjustment are limited to still images.

In this conventional example, it is not possible to continuously conduct adjustment, so that a switch operation is also necessary in order to initiate adjustment, and this has the additional drawback that this operation is complex, and furthermore, in the timing adjustment, a number of frame intervals are required, so that time is required for the timing adjustment.

Furthermore, in the conventional phase adjusting circuit shown in FIG. 7, the edge of the video signal is detected, and synchronization is conducted with respect to a set pulse which is delayed by a prespecified time from the edge detection signal, and thereby, the timing of the sampling point is adjusted; however, in cases in which, as a result of the personal computer or the like outputting the video signal which is to be displayed, the wave-form of differing video signals becomes disordered as a result of noise or the like originating in ringing or reflection or the like, and this affects the timing of the set pulse delayed by a predetermined period from the edge, it becomes impossible to guarantee the set up time required in the sampling circuit of the pixel data, and the timing of the sampling point is not set to the appropriate timing. Additionally, when the level of the noise or the like arising from ringing or reflection or the like of the video signal is high, edge detection is conducted with respect to the wave form of this noise or the like in the edge detecting circuit, and it becomes impossible to optimally adjust the sampling point.

SUMMARY OF THE INVENTION

The first liquid crystal display device of the present invention comprises a liquid crystal display device which is provided with: a phase synchronizing circuit, into which a horizontal synchronizing signal is inputted and which generates and outputs a standard clock signal synchronized with the horizontal synchronizing signal; a phase adjusting circuit into which a specified video signal which is to be displayed is inputted, and which, via the standard clock signal outputted from the phase synchronizing circuit, generates and outputs a sampling clock signal having an appropriate phase for sampling pixel data of the video signal; a pixel data sampling circuit, into which the video signal is inputted and which samples the pixel data of the video signal via the sampling clock signal, and generates and outputs sampling image data; a video processing circuit, which conducts video processing with respect to the sampling image data, and generates and output image data for image display; and a liquid crystal panel into which image data for image display is inputted, and which displays these data; wherein the phase adjusting circuit is provided with: a sampling circuit for detection, into which the video signal is inputted, and which conducts the sampling of the video signal via the standard clock signal, and which outputs first sampling data for potential level determination period detection; a stable period detecting circuit, into which the first sampling data is inputted, and which detects the presence or absence of potential changes in each sampling point adjoining the sampling data, and which generates and outputs a signal indicating the potential stable period of the first sampling data from the results of the detection; a divider circuit, into which the standard clock signal is inputted, and which divides the frequency of the standard clock signal and generates and outputs a divided clock signal; a controller, which accepts as input the signal showing the potential stable period of the first sampling data, and which counts the periods in which the potential change of the video signal is stable, with reference to the signal indicating the potential stable periods, and on the basis of the results of this count, makes a determination as to whether the set up period and hold period, which are set in advance as necessary conditions for the image data sampling function, can be guaranteed, and in the case of a determination that it is possible to guarantee the necessary conditions, calculates the phase after the set up period from the stable initiation point of the potential level, and with reference to the results of this calculation, generates and outputs a control signal for phase control with respect to the divided clock signal; and a delay circuit, into which the divided clock signal outputted from the divider circuit is inputted, and which controls and adjusts the phase of the divided clock signal via the control signal outputted from the controller, and outputs this to the image data sampling circuit as a second sampling clock signal.

Furthermore, the second liquid crystal display device of the present invention comprises a liquid crystal display device which is provided with: a phase synchronizing circuit into which a horizontal synchronizing signal is inputted and which generates and outputs a standard clock signal synchronized with the horizontal synchronizing signal; a phase adjusting circuit, into which a specified video signal which is to be displayed is inputted, and which, via the standard clock signal outputted from the phase synchronizing circuit, generates and outputs a sampling clock signal having an appropriate phase for sampling pixel data of the video signal; a pixel data sampling circuit, into which the video signal is inputted and which samples the pixel data of the video signal via the sampling clock signal, and generates and outputs sampling image data; a video processing circuit, which conducts video processing with respect to the sampling image data, and generates and output image data for image display; and a liquid crystal panel into which image data for image display is inputted, and which displays these data; wherein the phase adjusting circuit is provided with: a sampling clock generating circuit for detection, into which the standard clock signal is inputted, which breaks down the standard clock signal into a number m (m:0, 1, 2, . . . , m) of standard clock signals, and with respect to the various standard clock signals, having delay amount proportional to the amount of the cycle of the standard clock signal divided by m, generates and outputs a number m of sampling clock signals which are formed so as to provide the various delay phase amounts of m a sampling circuit for detection, into which the video signal is inputted, and which samples, via the number m of sampling clock signals, the periods corresponding to one pixel of the video data at number m of sampling points, and generates and outputs a number m of corresponding sampling data; a stable period detecting circuit, into which the number m of sampling data are inputted, and which detects the presence or absence of a change in potential at each sampling point adjoining the number m of sampling data, and based on the results of this detection, generates and outputs a signal indicating the potential stable period of each sampling data; a controller, which accepts as an input the signal indicating the potential stable period of each sampling data, counts the periods at which the potential change of the video data is stable with reference to the signal showing the potential stable periods, and using the results of this count, makes a determination as to whether it is possible to guarantee the set up period and hold period which are set in advance as necessary conditions of the image data sampling function, and in the case in which a determination is made that it is possible to guarantee the necessary conditions, calculates the phase after the set up period from the stable initiation point of the potential level, and with reference to the results of this calculation, outputs a control signal for phase control with respect to the sampling clock signal of the image data; and a selecting circuit, into which are inputted the number m of sampling clock signals outputted from the sampling clock generating circuit for detection, and which, by means of the control signal, selects and outputs the sampling clock signal having the optimal phase relationship from among the number m of sampling clock signals.

DESCRIPTION OF THE PREFERRED EMBODIMENTS

Next, the present invention will be explained with reference to the diagrams.

Figure 1:
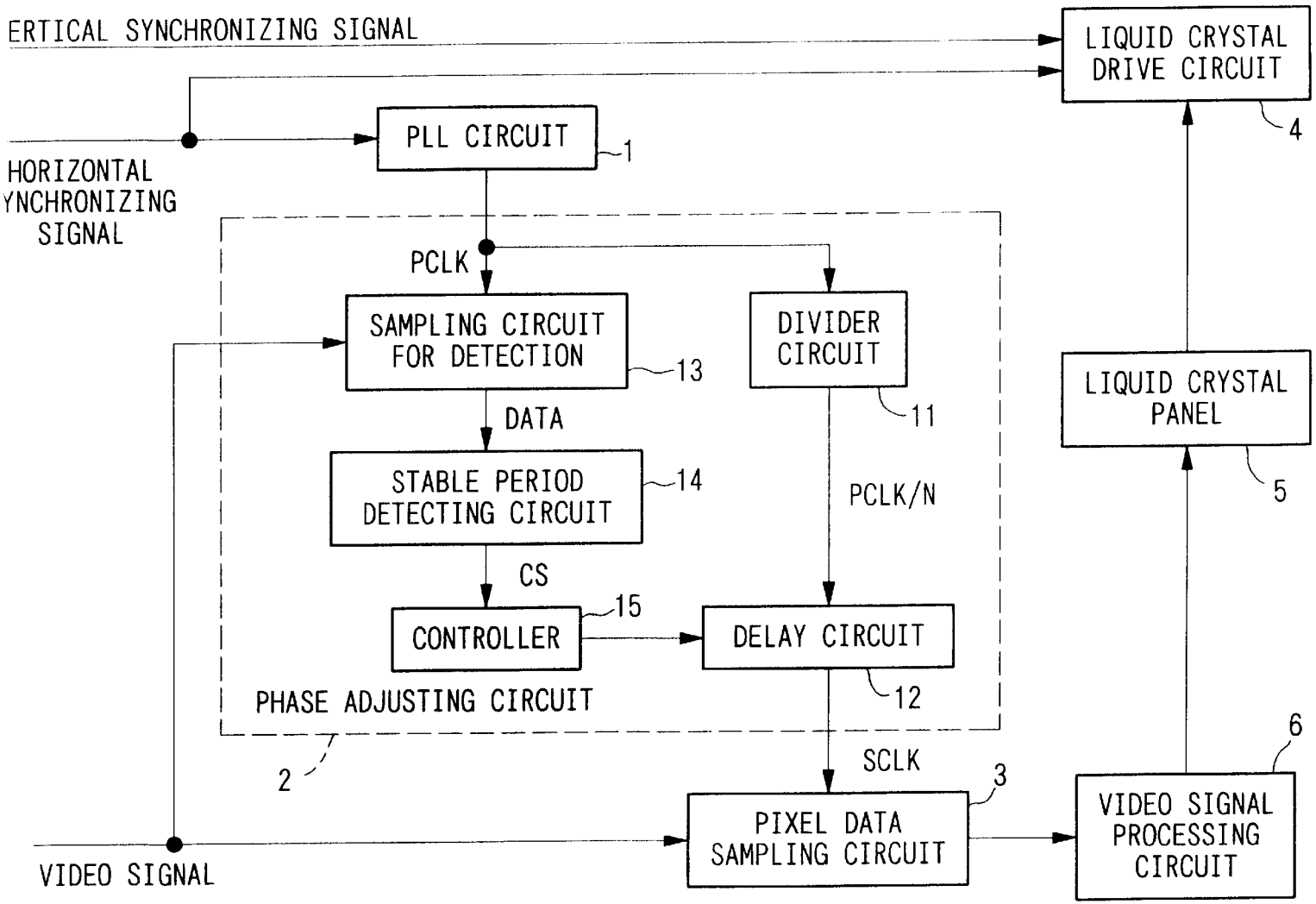
FIG. 1 is a block diagram showing the structure of a first embodiment of the present invention.

FIG. 1 is a block diagram showing the structure of the essential parts of a first embodiment of the present invention. As is shown in FIG. 1, the present embodiment is provided with: a PLL circuit 1, which generates and outputs a standard clock (PCLK) synchronized with the horizontal synchronizing signal; a phase adjusting circuit 2, including a divider circuit 11, a delay circuit 12, a sampling circuit for detection 13, a stable period detecting circuit 14, and a controller 15, which accepts as inputs the video signal and the standard clock (PCLK), adjusts the phase of the standard clock (PCLK), and generates and outputs a sampling clock (SCLK), the frequency of which is divided to 1/N (where N is a positive integer); a pixel data sampling circuit 3, into which the video signal is inputted, and which outputs sampling data via the sampling clock (SCLK); a liquid crystal drive circuit 4, into which the vertical synchronizing signal and the horizontal synchronizing signal are inputted, and which generates and outputs a liquid crystal drive signal; a video signal processing circuit 6, which conducts video processing including gamma correction and polarity reversal and the like with respect to the sampling data outputted from pixel data sampling circuit 3; and a liquid crystal panel 5, into which are inputted the image data processed in the video signal processing circuit 6, and which displays these data via the liquid crystal drive signal.

Figure 2:
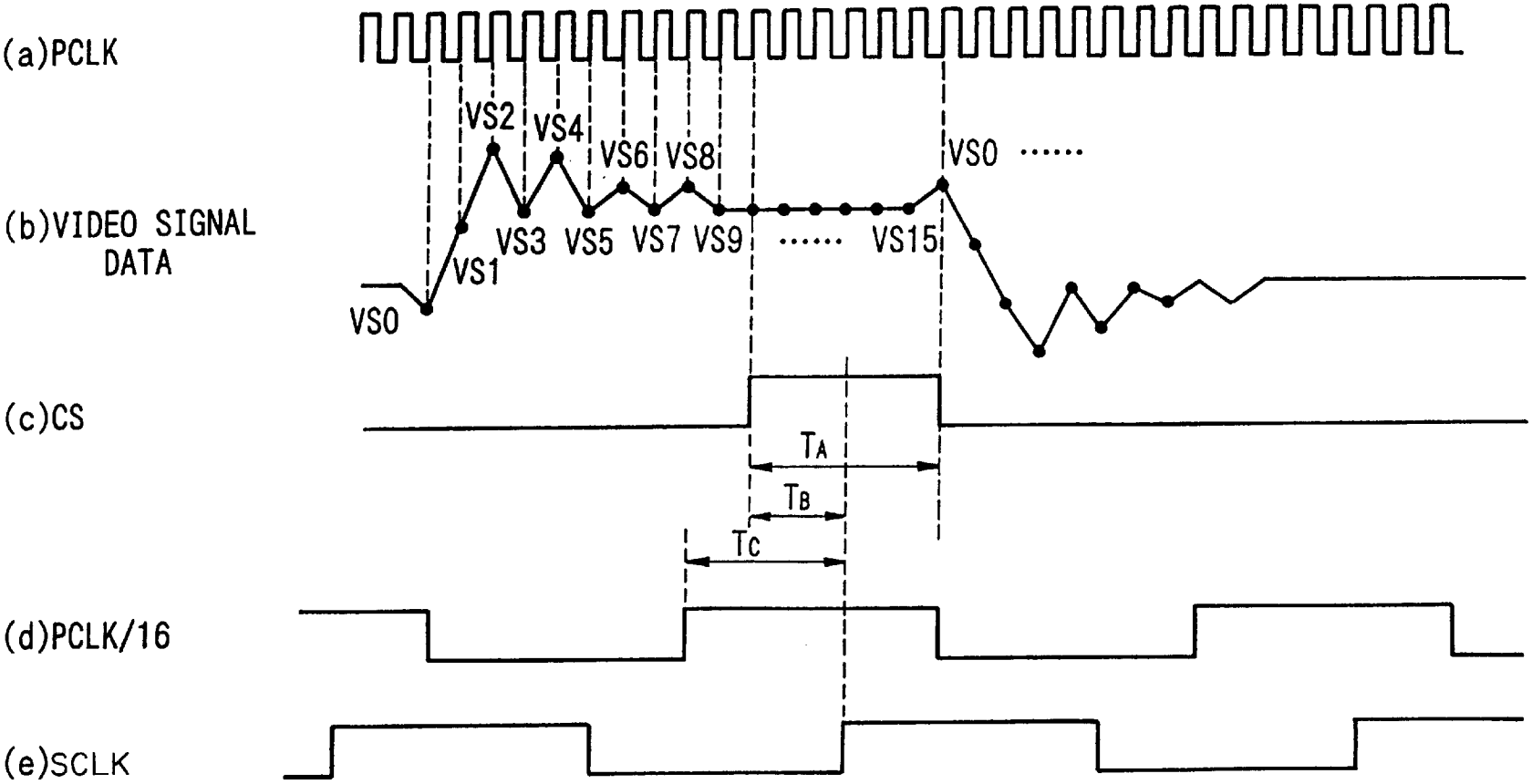
FIG. 2 is an operational timing diagram relating to the first embodiment.

Furthermore, FIGS. 2(*a*), (*b*), (*c*), (*d*), and (*e*) are timing diagrams showing each signal in the present embodiment: FIG. 2(*a*) indicates the standard clock (PCLK) outputted from the PLL circuit 1, FIG. 2(*b*) shows the inputted video signal (continuous waveform display) and the sampling data (DATA: dot display) outputted from sampling circuit 13 for detection, FIG. 2(*c*) indicates the signal (CS) indicating the stable period outputted by stable period detecting circuit 14, FIG. 2(*d*) indicates the divided clock (PCLK/16) outputted by the divider circuit 11 when the dividing value N is 16, and FIG. 2(*e*) indicates the sampling clock (SCLK) outputted by the delay circuit 12.

Hereinbelow, with references to FIGS. 1 and 2, the operation of the present embodiment will be explained in the case in which the dividing value N of the divider circuit 11 is 16. Accordingly, the divided clock (PCLK/N) outputted from the divider circuit 11 shown in FIG. 1 is replaced with a divided clock (PCLK/16) for the explanation of the operation.

In FIG. 1, PLL circuit 1 accepts the horizontal synchronizing signal as an input, and a standard clock (PCLK: see FIG. 2(*a*)) is generated which is phase synchronized with the horizontal synchronizing circuit, and this is inputted into the divider circuit 11 and the sampling circuit for detection 13 within the phase adjusting circuit 2. In divider circuit 11, the frequency of the sampling clock (PCLK) is divided by 16, and a divided clock (PCLK/16: see FIG. 2(*b*)) is generated, and this is inputted into delay circuit 12. Furthermore, in sampling circuit for detection 13, the inputted video signal (see the continuous wave form of FIG. 2(*b*)) is sampled via the standard clock (PCLK), and the sampling data of the video signal (DATA: see the dot display of FIG. 2(*b*)) is outputted and inputted into stable period detecting circuit 14. In stable period detecting circuit 14, the sampling data (DATA) outputted by sampling circuit for detection 13 are accepted as inputs, and a comparison of the level values of the sampling potentials at two adjoining sampling points is repeatedly conducted. In this way, by repeatedly conducting a comparison of adjoining sampling potentials, the presence or absence of potential changes in the inputted sampling data (DATA) is detected, and using the results of this detection, a signal (CS: see FIG. 2(*c*)) showing the potential stable periods of the sampling data (DATA) is outputted, and this is inputted into controller 15. In controller 15, the signal (CS) is accepted as input, and with reference to this signal (CS), a count is conducted of the periods in which there is no change in potential in the inputted video signal, so that it is stable, and from the results of this count, in pixel data sampling circuit 3, when a determination has been made that it is possible to guarantee the necessary set up period and hold period which are set in advance, then the phase after the set up period which is set in advance is calculated from the initiation point of the stable period of the potential level, and a control signal corresponding to the results of this calculation is outputted and inputted into delay circuit 12. In delay circuit 12, the divided clock (PCLK/16) outputted from the divider circuit 11 is accepted as input, and the delay amount of the divided clock (PCLK/16) is adjusted to the appropriate amount by means of the control signal inputted by controller 15, and a sampling clock in which the frequency is divided by 16 (SCLK: see FIG. 2(*e*)) is generated, and this is inputted into pixel data sampling circuit 3. In pixel data sampling circuit 3, the video signal inputted from the personal computer or the like is sampled via this sampling clock (SCLK), and the sampling data output is inputted into video processing circuit 6. In video processing circuit 6, as described above, processing which includes gamma correction and polarity inversion and the like is conducted with respect to the sampling data, and image data for liquid crystal display are generated and outputted, these data are inputted into liquid crystal panel 5, and these data are displayed via the liquid crystal drive signal outputted by liquid crystal drive circuit 4.

In the embodiment described above, the explanation centered on the case in which the dividing value N in divider circuit 11 had a value of 16; however, the dividing value N exerts an influence on the number of sampling points used for stable period detection, that is to say, on the smallest unit of stable period detection, and this value also determines the adjustment precision, so that when this value N is too small, there is no adjustment effect, and it is thus necessary that N be set to the maximum value which will permit circuit operation, and a value of at least 16 is desirable.

In addition, in the comparison determination of the sampling potential in stable period detecting circuit 14, the detection precision which is required depends on the number of display colors of the video signal which is inputted; precision which permits the detection of differences in potential in each of the unit gradations of R, G, and B is necessary. For example, if the video signal inputted is 0.7 Vpp, then in the case of the display of 256 color gradations, precision sufficient to discriminate differences of 2.7 mV is required.

Next, with respect to the operation of phase adjusting circuit 2 shown in FIG. 1, this will be explained with reference to the timing diagrams shown in FIGS. 2(*a*), (*b*), (*c*), (*d*), and (*e*).

As described previously, the display of the continuous wave form shown in the timing diagram of FIG. 2(*b*) indicates the video signal inputted from a personal computer or the like; however, the continuous pixel data of this video signal are displayed as wave forms formed as black, white, black. With respect to this video signal, in sampling circuit for detection 13, each potential of the video signal is sampled at sampling points from $VS_0$ to $VS_{15}$, as shown in FIG. 2(*b*), in accordance with the standard clock (PCLK) shown in FIG. 2(*a*). The sampling data (DATA) at each of these sampling points are inputted into the stable period detecting circuit 14, and the various adjoining potentials of the sampling points $VS_0$ and $VS_1$, $VS_1$ and $VS_2$, $VS_2$, and $VS_3$, $VS_3$, and $VS_4$, . . . , $VS_{14}$ and $VS_{15}$ are compared, and when as a result of this comparison the potentials are at the same level, a binary signal indicating an "H" level is generated, and as shown in FIG. 2(*c*), this is outputted as signal (CS) and inputted into controller 15. In controller 15, the time $T_A$ during which the signal (CS) is maintained at an "H" level is counted, and this is compared with the set up time and the hold time which are required in the pixel data sampling circuit 3 and are preset, and the quality of the inputted video signal is evaluated in controller 15. Furthermore, with respect to the phase after the passage of the set up time $T_B$, which is required in the pixel data sampling circuit 3 and is preset, from the beginning of the signal (CS), the delay amount $T_C$ required to bring the timing of the sampling clock (SCLK) for pixel sampling into conformity with this is calculated in controller 15. Then, by applying the delay amount $T_C$ which was calculated with respect to the divided clock (PCLK/16) inputted from divider circuit 11, a sampling clock (SCLK) for pixel data sampling which provides an appropriate phase is generated and outputted in delay circuit 12, as shown in FIG. 2(*e*).

Figure 3:
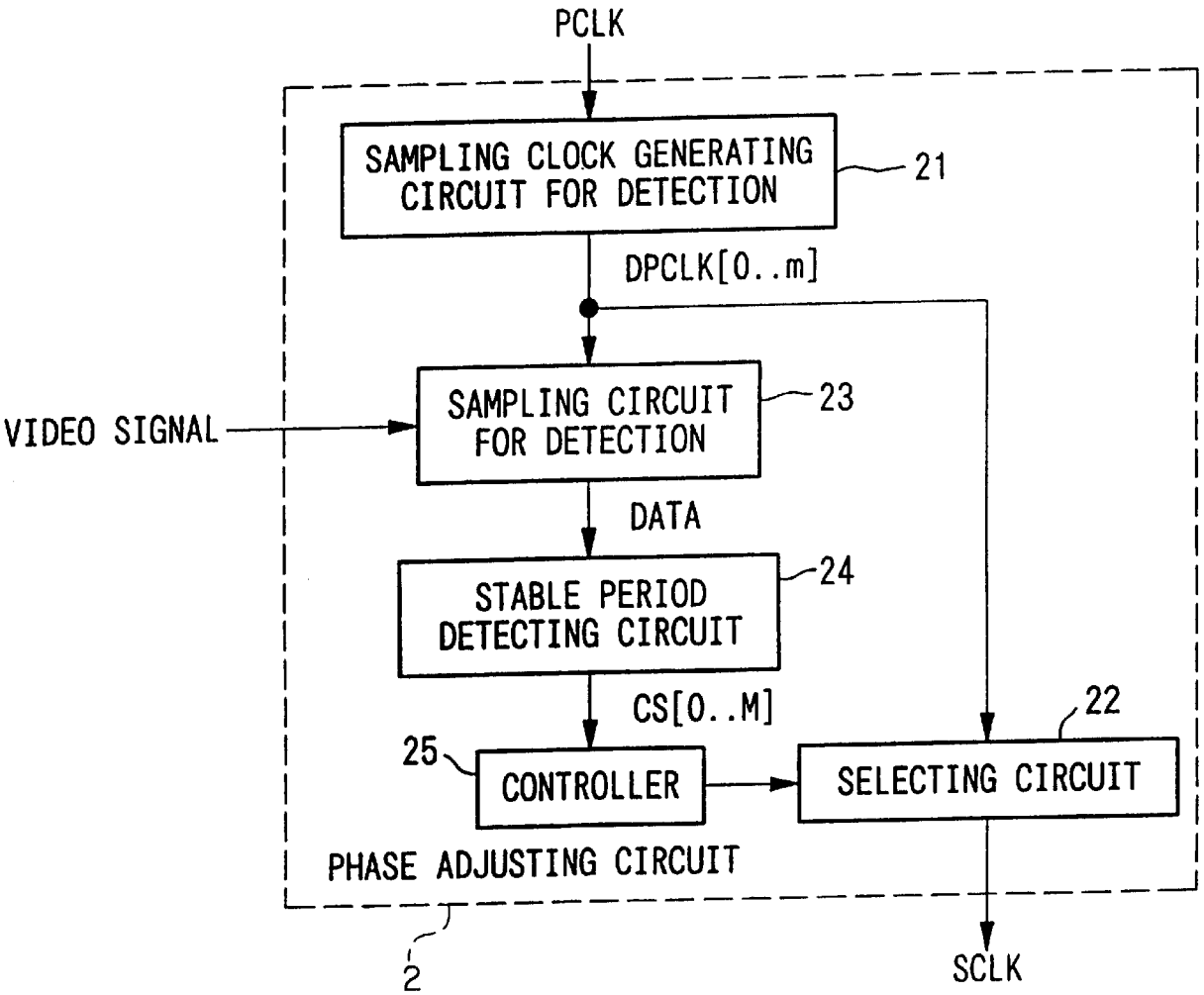
FIG. 3 is a block diagram showing the structure of a second embodiment of the present invention.

FIG. 3 is a block diagram showing the structure of the phase adjusting circuit in a second embodiment of the present invention. As is shown in FIG. 3, the phase adjusting circuit 2 of the present embodiment is provided with: a sampling clock generating circuit for detection 21, into which a standard clock (PCLK) which is synchronized with a horizontal synchronizing signal is inputted, and which divides this standard clock (PCLK) into a number m (a positive integer) of standard clocks, and which applies, with respect to these standard clocks, a delay amount proportional to the amount of the cycle thereof divided by m, and which generates and outputs, in stages, a number m of sampling clocks for detection (DPCLK[0,1,2, . . . ,m]) having different phases; a sampling circuit for detection 23, which accepts as an input the sampling clocks for detection (DPCLK[0, 1, 2, . . . ,m]), and which is formed from a number m of sampling circuits which sample, at a number m of points, intervals corresponding to each pixel of the video signal inputted from a personal computer or the like via the sampling clocks for detection (DPCLK[0, 1, 2, . . . , m]); a stable period detecting circuit 24, which includes a number m of comparator circuits which conduct a comparison of sampling potentials at a number m of adjoining pairs of sampling points of the sampling data outputted from a number m of sampling circuits, and which detects the presence or absence of a change in potential of the video signals which are inputted, and in the case in which there is no change in the potential and the signal is stable, outputs a signal (CS[0, 1, 2, . . . , M]) indicating the potential stable period of the corresponding sampling data; a controller 25, which accepts as inputs the signals (CS[0, 1, 2, . . . , M]), and with reference to these signals (CS[0, 1, 2, . . . , M]), conducts a count of the intervals in which there is no change in potential in the inputted video signal and the signal is stable, and by means of the results of this count, when a determination has been made, in the pixel data sampling circuit (not shown in FIG. 3; see the pixel data sampling circuit 3 of FIG. 1), that it is possible to guarantee the necessary set up time and hold time which were preset, the phase after the preset setup time from the point of initiation of the stable period of the potential level is calculated, and the controller generates and outputs a control signal which serves to select, from among the number m of sampling clocks for detection corresponding to the results of the calculations, the sampling clock which has the optimal phase relationship; and a selecting circuit 22, which accepts as an input the sampling clocks for detection (DPCLK[0, 1, 2, . . . , m]) which were outputted by the sampling clock generating circuit for detection 21, controls these by means of the control signal, selects the appropriate sampling clock for detection from among these, and outputs this as the sampling clock (SCLK) to the pixel data sampling circuit. The value of m described above has an effect on the number of sampling points used for stable period detection, or in other words, has an effect on the smallest unit of stable period detection, and this value determines the precision of phase adjustment. Accordingly, when the value of m is too small, the adjustment effect is lost, so that it is desirable that this value be set to the maximum value at which the circuit can operate, and a value of at least 16 is desirable.

Next, using 16 as the value of m, the operation of the phase adjusting circuit shown in FIG. 3 will be explained with reference to the timing diagrams shown in FIGS. 4(*a*), (*b*), (*c*), (*d*), (*e*), (*f*), (*g*), (*h*), (*i*), (*j*), (*k*), (*l*), and (*m*).

Figure 4:
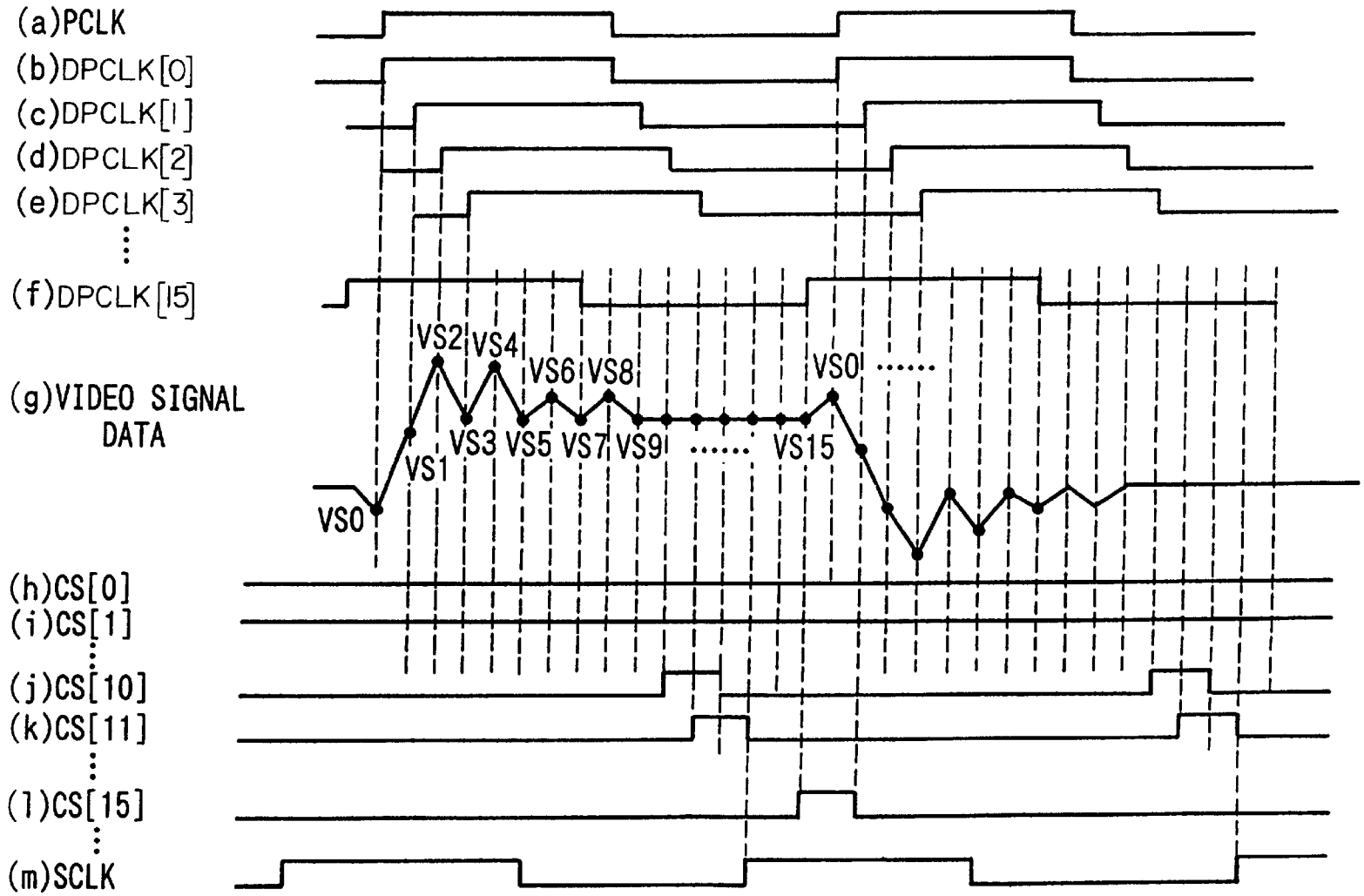
FIG. 4 is an operational timing diagram relating to the second embodiment.
Figure 5:
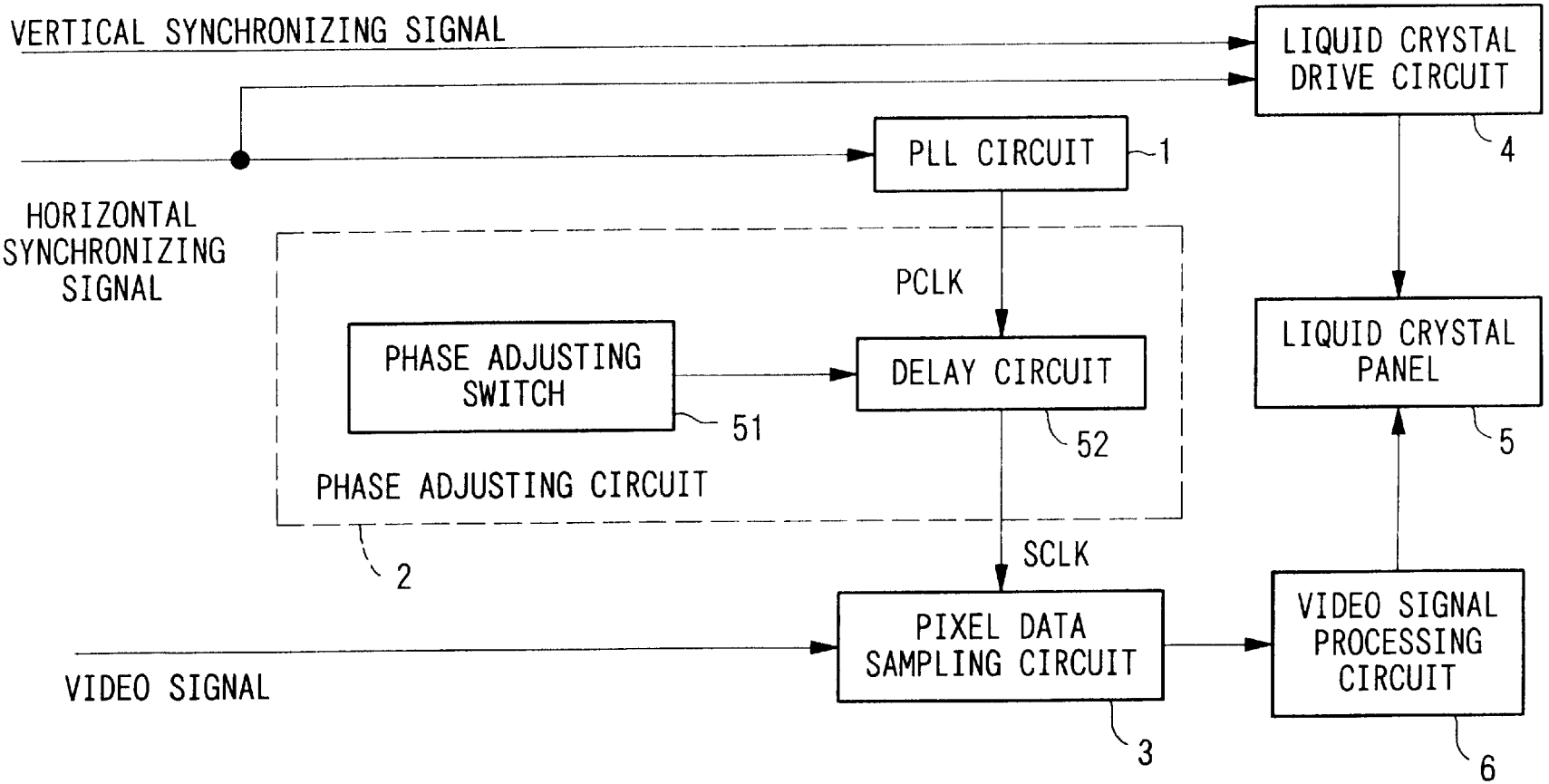
FIG. 5 is a block diagram showing the structure of a conventional example.
Figure 6:
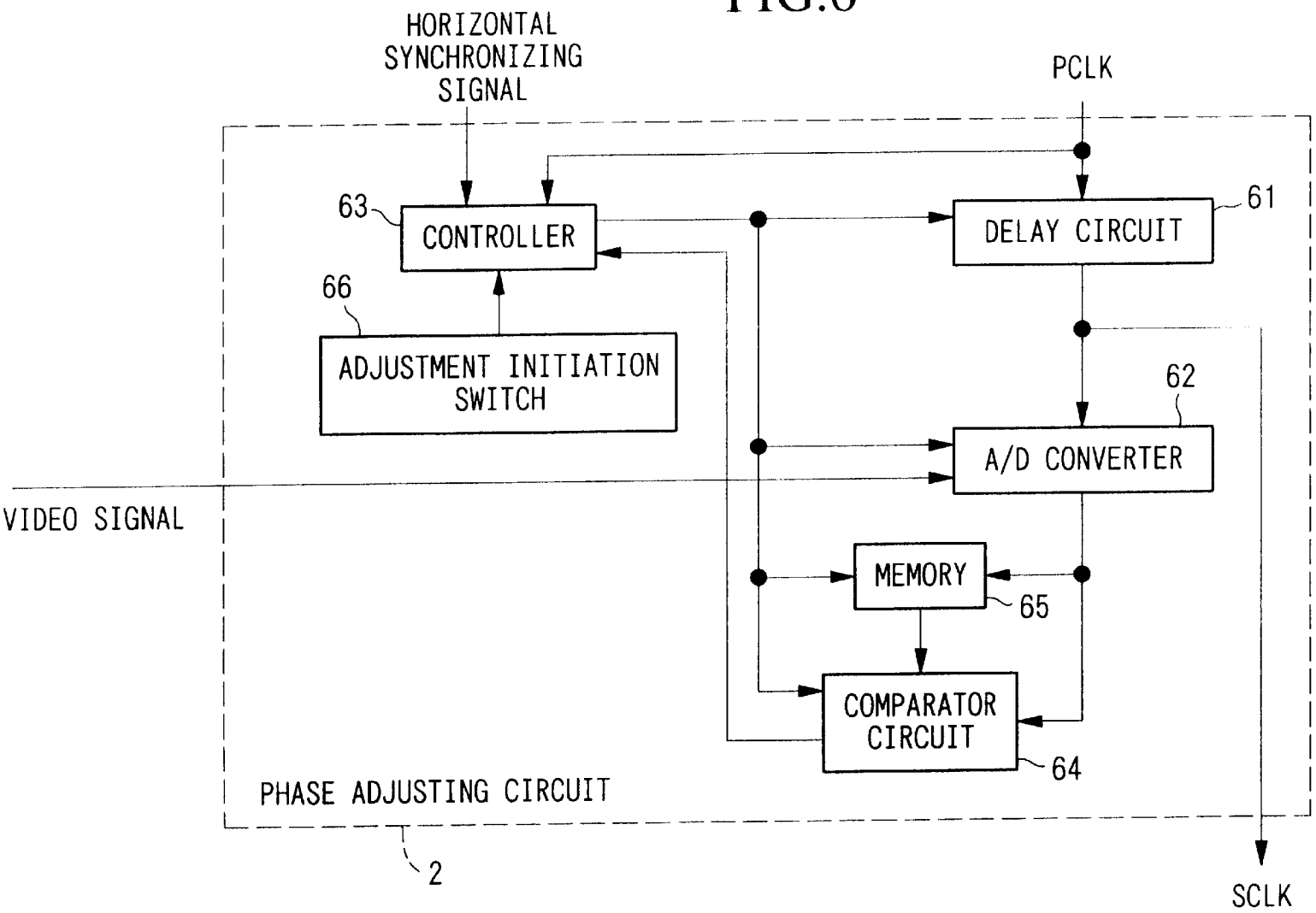
FIG. 6 is a block diagram showing the structure of a phase adjusting circuit in accordance with another conventional example.
Figure 7:
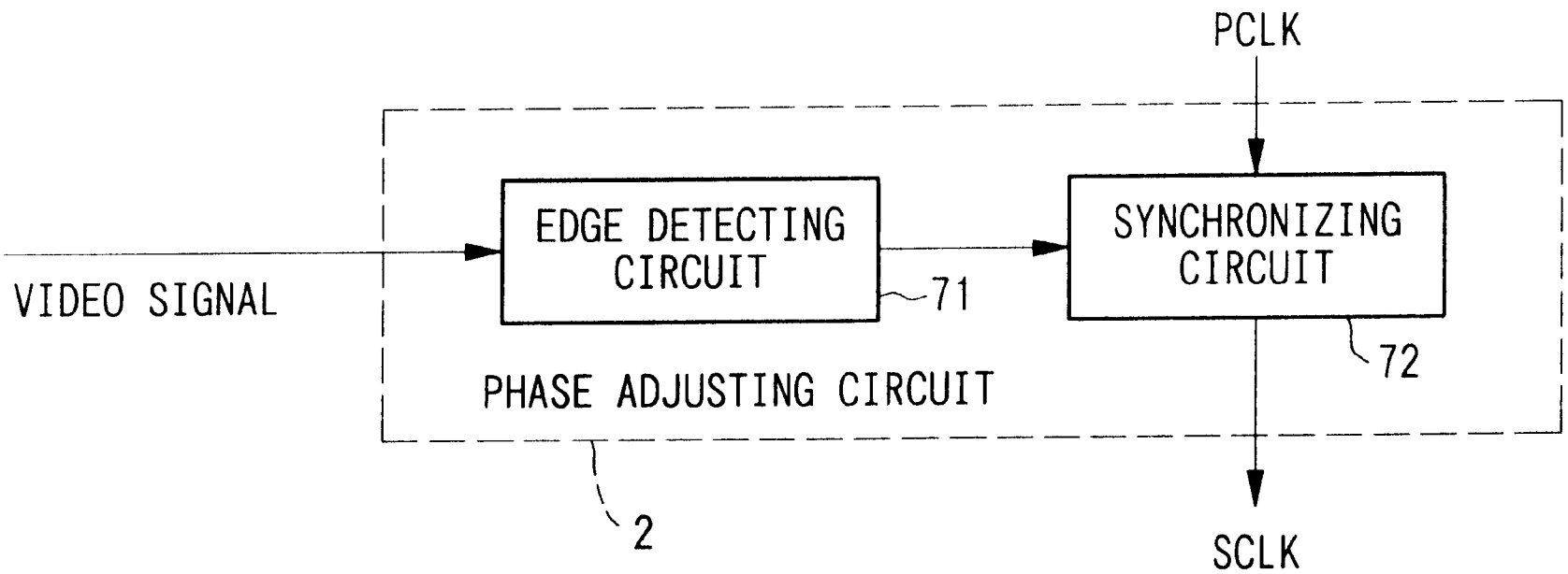
FIG. 7 is a block diagram showing the structure of a phase adjusting circuit in accordance with another conventional example.

The continuous wave form display shown in the timing diagram of FIG. 4(*g*) indicates the video signal which is inputted from a personal computer or the like; the continuous pixel data are displayed as a wave form which is formed in a black, white, black manner. A number m of sampling clocks for detection (DPCLK[0, 1, 2, . . . , m]) is outputted from sampling clock generating circuit for detection 21, as shown in FIGS. 4(*b*), (*c*), (*d*), (*e*), . . . , and these are inputted into sampling circuit for detection 23. With respect to the inputted video signals, the potentials of the video signal at each sampling point from $VS_0$ to $VS_{15}$ are sampled in sampling circuit 23 for detection, as shown by the dot display in FIG. 4(*g*), by means of the number m of sampling clocks for detection (DPCLK[0, 1, . . . , m]), and the sampling data (DATA) at these sampling points are inputted into stable period detecting circuit 24. The potentials of adjoining sampling points $VS_0$ and $VS_1$, $VS_1$ and $VS_2$, $VS_2$ and $VS_3$, $VS_3$ and $VS_4$, . . . , $VS_{14}$ and $VS_{15}$ are compared in the 16 comparator circuits, and in the case in which as a result of these comparisons, the potential was at the same level, signal (CS[10]), signal (CS[11]) , . . . , and signal (CS[15]), are generated in stable period detecting circuit 24 as binary signals indicating an "H" level, as shown in FIGS. 4(*j*), (*k*), . . . , (*l*), and these signals are outputted. In the case of the signal (CS[0]) and the signal (CS[1]) shown in FIGS. 4(*h*) and (*l*), the potential does not have the same level at the corresponding sampling points, so that a binary signal indicating an "L" level is generated. The "H" level signals (CS) are inputted into controller 25, and from the number of these "H" level signals (CS), the periods are counted at which the inputted video signal was stable, and in a manner similar to that of the first embodiment, a comparison is conducted of the set up time and hold time necessary in the pixel data sampling circuit which was preset, and a determination is made with respect to the quality of the inputted video signal. Furthermore, as can be seen from FIGS. 4(*j*), (*k*), and (*l*), the initiation timing during which the signal was stable is detected from the "H" level signals (CS) outputted from the stable period detecting circuit 24, and the phase after the set up time required in the pixel data sampling circuit which was preset is calculated. Additionally, a control signal which operates so as to select the sampling clock for detection having the closest phase relationship to this calculated phase is outputted by controller 25, and by means of this control signal, in selecting circuit 22, the sampling clock for detection having the closest phase relationship is selected on the basis of the results of this calculation from among the sampling clocks for detection outputted by the sampling clock generating circuit for detection 21, and as shown in FIG. 4(*m*), this is outputted as a sampling clock signal (SCLK).

As explained above, in the present invention, in a freely selected display screen including moving images, sampling is conducted with respect to the data of one pixel of the inputted video signal by means of a sampling clock having a frequency higher than the dot clock frequency of the video signal, the potential changes in the video signal are observed in detail, potential level fluctuations and subsequent stability of the signal wave form are detected, the appropriate phase with respect to the video signal is calculated, and the automatic phase adjustment of the sampling clock of the pixel data is conducted with reference to the results of this calculation, and thereby, it is possible to conduct normal liquid crystal display in a rapid manner without requiring operational control by a human being.

Furthermore, as described above, sampling is conducted by means of a sampling clock having a frequency higher than that of the dot clock of the video signal, and the potential changes of the video signal are observed in detail, and thereby, wave form variations in the inputted video signal resulting from differing interfering ringing, noise, or the like, and stable periods in which there are no fluctuations in the potential level, are detected, and the appropriate phase is calculated via a comparison between the stable periods and the desired sampling period of the pixel data, and an automatic phase adjustment of the pixel data sampling clock is conducted with reference to the results of this calculation, and thereby, the quality of the wave form variations resulting from the ringing or noise described above can be ascertained, and the automatic phase adjustment of the sampling clock can be conducted without affecting the length of the unstable periods resulting from ringing or noise or the like, and thereby it is possible to conduct normal liquid crystal display.

What is claimed is:

1. A liquid crystal display device, comprising:

a phase synchronizing circuit, into which a horizontal synchronizing signal is inputted and which generates and outputs a standard clock signal synchronized with said horizontal synchronizing signal;

a phase adjusting circuit which receives as inputs a specified video signal and said standard clock signal outputted from said phase synchronizing circuit, and outputs a sampling clock signal having an appropriate phase for sampling pixel data of the video signal;

a pixel data sampling circuit, which receives said video signal and said sampling clock signal, and generates and outputs sampling image data;

a video signal processing circuit, which receives an input from said pixel sampling circuit and which conducts video processing with respect to said sampling image data, and outputs image data for image display; and a liquid crystal panel which receives image data for image display, and which displays the image data;

wherein said phase adjusting circuit further comprises:

a sampling circuit for detection, which receives the standard clock signal and said video signal and samples the video signal via said standard clock signal to produce first sampled video data as output, wherein each data point of the first sampled video data represents a potential level of the video signal;

a stable period detecting circuit, which receives said first sampled video data and compares consecutive data points of the first sampled video data to generate an output signal indicating a potential stable period of said first sampled video data, wherein the potential stable period is triggered when two consecutive data points have the same potential level;

a divider circuit, which receives said standard clock signal and divides a frequency of said standard clock signal and outputs a divided clock signal;

a controller, which receives an input from said stable period detecting circuit indicating the potential stable period of said first sampled video data, and which counts the duration of said stable period, and compares the stable period duration to a predetermined set up period and hold period duration which is required to perform an image data sampling function, and if the stable period duration is equal to or greater than the predetermined set up and hold period, said controller calculates a phase shift value which is to be offset from a stable period initiation point of the potential stable period and, based on the results of this calculation, generates and outputs a phase control signal to the divided clock signal; and a delay circuit, which receives said divided clock signal from said divider circuit and the phase control signal from said controller to adjust a phase of the divided clock signal based on the phase control signal, to produce a second sampling clock signal for outputting to said image pixel data sampling circuit.

2. A liquid crystal display device, comprising:

a phase synchronizing circuit into which a horizontal synchronizing signal is inputted and which generates and outputs a standard clock signal synchronized with said horizontal synchronizing signal;

a phase adjusting circuit, which receives as inputs a specified video signal and said standard clock signal outputted from the phase synchronizing circuit, and outputs a sampling clock signal having an appropriate phase for sampling pixel data of said video signal;

a pixel data sampling circuit, which receives said video signal and said sampling clock signal, and generates and outputs sampling image data;

a video processing circuit, which receives an input from said pixel sampling circuit and which conducts video processing with respect to said sampled image data, and outputs image data for image display; and a liquid crystal panel which receives image data for image display, and which displays the image data;

wherein said phase adjusting circuit further comprises:

a sampling clock generating circuit for detection, which receives said standard clock signal and which breaks down said standard clock signal into a number m (m:0, 1, 2, . . . , m) of standard clock signals, and outputs the number m of sampling clock signals to provide various delay phase amounts, wherein said various delay amounts are proportional to an amount of a cycle of the standard clock signal divided by m;

a sampling circuit for detection, which receives the number m of sampling clock signals and said video signal, and which samples, via said number m of sampling clock signals, the video data at a number m of sampling points to output a number m of corresponding sampling data, wherein a sampling period corresponds to one pixel;

a stable period detecting circuit, which receives said number m of sampling data and compares consecutive sampling points of the number m of sampling data to generate an output signal indicating a potential stable period of sampled data, wherein the potential stable period is triggered when two consecutive sampling points have the same potential level;

a controller, which receives an input from said stable period detecting circuit indicating the potential stable period of sampled data, and which counts the number of potential stable periods to determine a total duration of the stable potential period, and compares the total duration of the stable potential period to a predetermined set up and hold period duration which is required to perform an image data sampling function, and if the total duration of the stable potential period is equal to or greater than the predetermined set up and hold period, said controller calculates a phase shift value which is to be offset from a stable period initiation point of the stable potential period and, based on the results of this calculation, outputs a phase control signal to the selecting circuit; and a selecting circuit, which receives said number m of sampling clock signals outputted from said sampling clock generating circuit for detection and the phase control signal from said controller, and which selects and outputs, from among the number m of sampling clock signals, the sampling clock signal having an optimal phase relationship with the phase control signal.

3. A liquid crystal display device as in claim 1, wherein the phase adjusting circuit automatically adjusts the phase of the sampling clock signal, thereby conducting normal liquid crystal display in a rapid manner without requiring manual intervention.

4. A liquid crystal display device as in claim 2, wherein the phase adjusting circuit automatically adjusts the phase of the sampling clock signal, thereby conducting normal liquid crystal display in a rapid manner without requiring manual intervention.

5. A phase adjusting device for updating the pixels of a liquid crystal display, comprising:

a sampling circuit for detection, which receives a standard clock signal and a video signal, and samples the video signal via the standard clock signal, to produce first sampled video data as output, wherein each data point of the first sampled video data represents a potential level of the video signal;

a stable period detecting circuit, which receives the first sampled video data and compares consecutive data points of the first sampled video data to generate an output signal indicating a potential stable period of said first sampling video data, wherein the potential stable period is triggered when two consecutive data points have the same potential level;

a divider circuit, which receives said standard clock signal and divides a frequency of said standard clock signal and outputs a divided clock signal;

a controller, which receives an input from said stable period detecting circuit indicating the potential stable period of said first sampled video data, and which counts the duration of said stable period, and compares the stable period duration to a predetermined set up and hold period duration which is required to perform an image data sampling function, and if the stable period duration is equal to or greater than the predetermined set up and hold period, said controller calculates a phase shift value which is to be offset from a stable period initiation point of the potential stable period and, based on the results of this calculation, generates and outputs a phase control signal to the divided clock signal; and a delay circuit, which receives said divided clock signal from said divider circuit and the phase control signal from said controller to adjust a phase of the divided clock signal based on the phase control signal, to produce a second sampling clock signal as output.

6. A phase adjusting device as in claim 5, wherein the phase of the sampling clock signal is automatically adjusted, without requiring manual intervention.

7. A phase adjusting device for updating the pixels of a liquid crystal display, comprising:

a sampling clock generating circuit for detection, which receives a standard clock signal and which breaks down said standard clock signal into a number m (m:0, 1, 2, . . . , m) of standard clock signals, and outputs the number m of sampling clock signals to provide various delay phase amounts, wherein the various standard delay amounts are proportional to an amount of a cycle of the standard clock signal divided by m;

a sample circuit for detection, which receives the number m of sampling clock signals and a video signal, and which samples, via said number m of sampling clock signals, the video data at a number m of sampling points to output a number m of corresponding sampling data, wherein a sampling period corresponds to one pixel;

a stable period detecting circuit, which receives said number m of sampling data, and compares consecutive sampling points of the number m of sampling data to generate an output signal indicating a potential stable period of sampled data, wherein the potential stable period is triggered when two consecutive sampling points have the same potential level;

a controller, which receives an input from said stable period detecting circuit indicating the potential stable period of sampled data, and which counts the number of potential stable periods to determine a total duration of the stable potential period, and compares the total duration of the stable potential period to a predetermined set up and hold period duration which is required to perform an image data sampling function, and if the total duration of the stable period potential period is equal to or greater than the predetermined set up and hold period, said controller calculates a phase shift value which is to be offset from a stable period initiation point of the stable potential period and, based on the results of this calculation, outputs a phase control signal to the selecting circuit; and a selecting circuit, which receives said number m of sampling clock signals outputted from said sampling clock generating circuit for detection and the phase control signal from said controller, and which selects and outputs, from among the number m of sampling clock signals, the sampling clock signal having an optimal phase relationship with the phase control signal.

8. A phase adjusting device as in claim 7 wherein the phase of the sampling clock signal is automatically adjusted, without requiring manual intervention.

9. A method of phase synchronizing a video signal for updating the pixels of a liquid crystal display, comprising the steps of:

(a) inputting a standard clock signal which is phase synchronized with a horizontal synchronizing signal;

(b) dividing said standard clock signal;

(c) inputting a video signal and sampling said video signal via said standard clock signal;

(d) comparing said sampled video signal at two consecutive sampling potentials and generating a signal indicating the duration of a potential stable period;

(e) counting the duration of the potential stable period and comparing the stable period duration to a predetermined set up and hold period duration, which is required to perform an image data sampling function;

(f) if the stable period duration is equal to or greater than a predetermined set up and hold period, calculating a phase shift value which is to be offset from a stable period initiation point of said potential stable period;

(g) delaying said divided standard clock signal in accordance with said calculated phase shift value; and (h) outputting a phase adjusted sampling clock.

10. A method of phase synchronizing a video signal for updating the pixels of a liquid crystal display as in claim 9, wherein the phase of the sampling clock signal is automatically adjusted without requiring manual control.

11. A method of phase synchronizing a video signal for updating the pixels of a liquid crystal display, comprising the steps of:

(a) inputting a standard clock signal which is phase synchronized with a horizontal synchronizing signal;

(b) breaking down said standard clock signal into a number m(m:, 1, 2, . . . , m) of standard clock signals;

(c) phase delaying said number m of standard clock signals by an amount proportional to a cycle of the standard clock signal, divided by m;

(d) inputting a video signal and sampling said video signal via said number m of sampling clock signals to produce sampling points;

(e) comparing consecutive sampling points to generate an output signal indicating the potential stable period of consecutively sampled data;

(f) counting the potential stable periods to determine a total duration of the stable potential period, and comparing the total duration to a predetermined set up and hold period duration which is required to perform an image data sampling function;

(g) if the total duration of the stable period potential period is equal to or greater than the predetermined set up and hold period, a calculation is performed of a phase shift value which is to be offset from a stable period initiation point of said potential stable period;

(h) selecting, from said phase delayed number m of standard clock signals, the clock signal having the optimal phase relationship with the phase control signal; and (i) outputting the selected standard clock signal of step (h) as an adjusted sampling clock.

12. A method of phase synchronizing a video signal for updating the pixels of a liquid crystal display as in claim 11, wherein the phase of the sampling clock signal is automatically adjusted, without requiring manual intervention.

* * * * *

UNITED STATES PATENT AND TRADEMARK OFFICE

CERTIFICATE OF CORRECTION

PATENT NO. : 6,097,379
DATED : August 1, 2000
INVENTOR(S) : Tsuyoshi Ichiraku

It is certified that error appears in the above-identified patent and that said Letters Patent is hereby corrected as shown below:

Column 2,
Line 49, after "62", insert -- which accepts as inputs the sampling clock SCLK, a video signal, and the delay adjusting signal, and subjects the video signal to A/D conversion and outputs this; a memory 65, which accepts as inputs the A/D converted output of the A/D converter 62 and the delay adjusting signal, and which stores the A/D converted output; and a comparator circuit 64, which compares the A/D converted output of the A/D converter 62 --.

Column 5,
Line 34, after "m" insert -- ; --.

Column 9,
Line 66, delete "(1)", insert -- (i) --.

Signed and Sealed this

Fifth Day of February, 2002

*Attest:*

*Attesting Officer*

JAMES E. ROGAN
*Director of the United States Patent and Trademark Office*